US008858048B2

(12) United States Patent
Nakazato

(10) Patent No.: US 8,858,048 B2
(45) Date of Patent: Oct. 14, 2014

(54) VEHICLE LIGHTING UNIT

(75) Inventor: Yoshiaki Nakazato, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 185 days.

(21) Appl. No.: 13/477,033

(22) Filed: May 21, 2012

(65) Prior Publication Data

US 2012/0294023 A1 Nov. 22, 2012

(30) Foreign Application Priority Data

May 19, 2011 (JP) ..... 2011-111958

(51) Int. Cl.
*F21V 13/14* (2006.01)
*F21V 13/08* (2006.01)
*F21S 8/10* (2006.01)

(52) U.S. Cl.
CPC ..... *F21S 48/1104* (2013.01); *F21S 48/1335* (2013.01); *F21S 48/1159* (2013.01); *F21S 48/1388* (2013.01)
USPC ..... 362/510; 362/84; 362/538; 362/539; 362/545

(58) Field of Classification Search
CPC ..... F21S 48/1104; F21S 48/1159; F21S 48/1335; F21S 48/1388
USPC ..... 362/510, 545, 84, 539, 538
See application file for complete search history.

(56) References Cited

U.S. PATENT DOCUMENTS

| | | | | |
|---|---|---|---|---|
| 8,439,537 | B2 * | 5/2013 | Nakazato et al. | 362/510 |
| 2006/0285341 | A1 * | 12/2006 | Yatsuda et al. | 362/464 |
| 2010/0328632 | A1 * | 12/2010 | Kurosaki et al. | 353/98 |
| 2011/0222265 | A1 * | 9/2011 | Drenten et al. | 362/84 |
| 2012/0057364 | A1 * | 3/2012 | Kishimoto et al. | 362/538 |
| 2012/0140501 | A1 * | 6/2012 | Nakazato et al. | 362/510 |
| 2012/0140504 | A1 * | 6/2012 | Fukai et al. | 362/516 |
| 2012/0163009 | A1 * | 6/2012 | Nakazato et al. | 362/510 |

FOREIGN PATENT DOCUMENTS

JP 4124445 B2 5/2008

* cited by examiner

*Primary Examiner* — Stephen F Husar
*Assistant Examiner* — James Cranson, Jr.
(74) *Attorney, Agent, or Firm* — Kenealy Vaidya LLP

(57) ABSTRACT

A vehicle lighting unit that utilizes a semiconductor laser light source can suppress color unevenness of a light distribution pattern while ensuring the usefulness of the semiconductor laser light source. The vehicle lighting unit can include a semiconductor laser light source, a phosphor configured to receive blue light emitted from the semiconductor laser light source and emit white light by excitation, and a reflector configured to reflect the light emitted from the phosphor so that the light can be diffused wider in a right-to-left direction than in a vertical direction on the basis of a posture when the lighting unit is mounted on a vehicle body. Part of the blue light that is emitted from the semiconductor laser light source and reflected off a surface of the phosphor can be incident on the reflector with an elongated area in the right-to-left direction.

11 Claims, 13 Drawing Sheets

VEHICLE LIGHTING UNIT

This application claims the priority benefit under 35 U.S.C. §119 of Japanese Patent Application No. 2011-111958 filed on May 19, 2011, which is hereby incorporated in its entirety by reference.

TECHNICAL FIELD

The presently disclosed subject matter relates to a lighting device, such as a vehicle lighting unit.

BACKGROUND ART

As one type of conventional vehicle lighting units such as a vehicle headlamp, a lighting unit utilizing a semiconductor light emitting element as a light source together with a wavelength conversion material such as a phosphor has been known (see, for example, Japanese Patent No. 4124445). With this type of vehicle lighting unit, the semiconductor light emitting element can emit light such as blue light, so that the phosphor can be irradiated with the blue light. Therefore, the phosphor can be excited to emit light such as yellow light. The blue light originated from the semiconductor light emitting element and the yellow light from the phosphor can be mixed to produce visible light such as white light. The visible light can be illuminated forward the vehicle body by means of an optical system including a reflector and the like.

In order for such a vehicle lighting unit to provide higher luminance irradiation light, a semiconductor laser light source that can emit higher luminance laser light may be utilized as the light source semiconductor light emitting element.

However, in the above conventional vehicle lighting unit, when excitation light is made incident on the phosphor from the light extraction direction of the phosphor, part of the excitation light can be reflected off the surface of the phosphor. That part of light may exit from the vehicle lighting unit without color mixture, thereby generating color unevenness in the light distribution pattern formed by the vehicle lighting unit. (That is the projection image by the vehicle lighting unit.)

When a semiconductor laser light source is used as the semiconductor light emitting element, almost all or substantially all the laser light (excitation light) emitted from the light source can be scattered by the phosphor to lose its coherency. Part of the laser light, however, can be reflected off the surface of the phosphor as described above and exit from the vehicle lighting unit with its coherency maintained. Therefore, if the power density thereof is made larger than the maximum permission exposure, deterioration of the usefulness of the semiconductor laser light source as a light source may occur.

SUMMARY

The presently disclosed subject matter was devised in view of these and other characteristics, problems and features and in association with the conventional art. According to an aspect of the presently disclosed subject matter, a vehicle lighting unit that utilizes a semiconductor laser light source can suppress the color unevenness of the light distribution pattern while ensuring the usefulness of the semiconductor laser light source.

According to another aspect of the presently disclosed subject matter, a vehicle lighting unit can include a semiconductor laser light source, a wavelength conversion material such as a phosphor configured to receive excitation light emitted from the semiconductor laser light source and emit visible light by excitation, and a reflector configured to reflect the light emitted from the wavelength conversion material so that the light can be diffused wider in a right-to-left direction than in a vertical direction on the basis of a posture where the lighting unit is mounted on a vehicle body, wherein part of the excitation light that is emitted from the semiconductor laser light source and regularly reflected off a surface of the wavelength conversion material can be incident on the reflector with an elongated area in the right-to-left direction.

The vehicle lighting unit with the above configuration can include a mirror configured to reflect the excitation light emitted from the semiconductor laser light source toward the wavelength conversion material and be disposed in front of the reflector, and the reflector can be disposed to cover the upper side of the wavelength conversion material, and the semiconductor laser light source can be disposed below the mirror so as to emit the excitation light upward, and can include a light emitting portion which has an elongated shape and which is configured to emit the excitation light spread wider in a short width direction than in a longitudinal direction (long width direction, elongated direction), and the semiconductor laser light source can be disposed such that the elongated shape of the light emitting portion is aligned in a front-to-rear direction.

Alternatively, the vehicle lighting unit with the above configuration can be configured such that the reflector is disposed to cover the upper side of the wavelength conversion material, and the semiconductor laser light source can be disposed behind the wavelength conversion material so that the excitation light is emitted forward, and can include a light emitting portion which has an elongated shape and which is configured to emit the excitation light spread wider in a short width direction than in a longitudinal direction (long width direction, elongated direction), and the semiconductor laser light source can be disposed such that the elongated shape of the light emitting portion is aligned in the vertical direction.

In any of the vehicle lighting units configured as described above, the semiconductor laser light source can include the light emitting portion which has an elongated shape and which is configured to emit the excitation light, and the excitation light emitted from the semiconductor laser light source can include a linear polarization component along the longitudinal direction of the light emitting portion and can be incident on the wavelength conversion material by a Brewster's angle (polarization angle).

Any of the vehicle lighting units configured as described above can include a collecting lens configured to collect the excitation light emitted from the semiconductor laser light source onto the surface of the wavelength conversion material. The collecting lens may be a spherical convex lens or an aspherical convex lens.

According to the presently disclosed subject matter, part of the excitation light that is emitted from the semiconductor laser light source and reflected off the surface of the wavelength conversion material can be incident on the reflector with a wide area in the right-to-left direction. This excitation light that is reflected can be diffused by the reflector wider in the right-to-left direction than in the vertical direction. This configuration can reduce the coherency of the excitation light. Furthermore, while the color (for example, blue) of the excitation light can be thinned down, the excitation light can exit from the vehicle lighting unit. Therefore, the vehicle lighting unit can suppress the color unevenness of the light distribution pattern while ensuring the usefulness of the semiconductor laser light source.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

Figure 1:
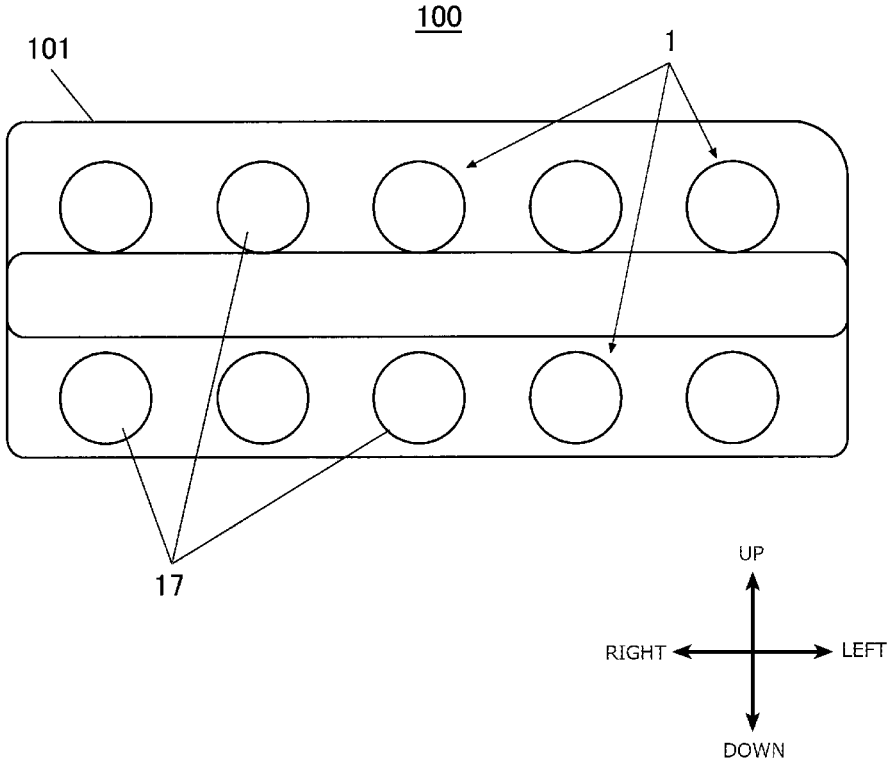
FIG. 1 is a front view of a vehicle headlamp in a first exemplary embodiment.

A description will now be made below to vehicle lighting units of the presently disclosed subject matter with reference to the accompanying drawings and in accordance with exemplary embodiments.

Herein, unless otherwise specified, the front, rear (back), left, right, up and down can be used as respective directions when the vehicle lighting unit is installed on a vehicle body with respect to the directions of the vehicle body, and correspond to the directions in the drawings.

Figure 2:
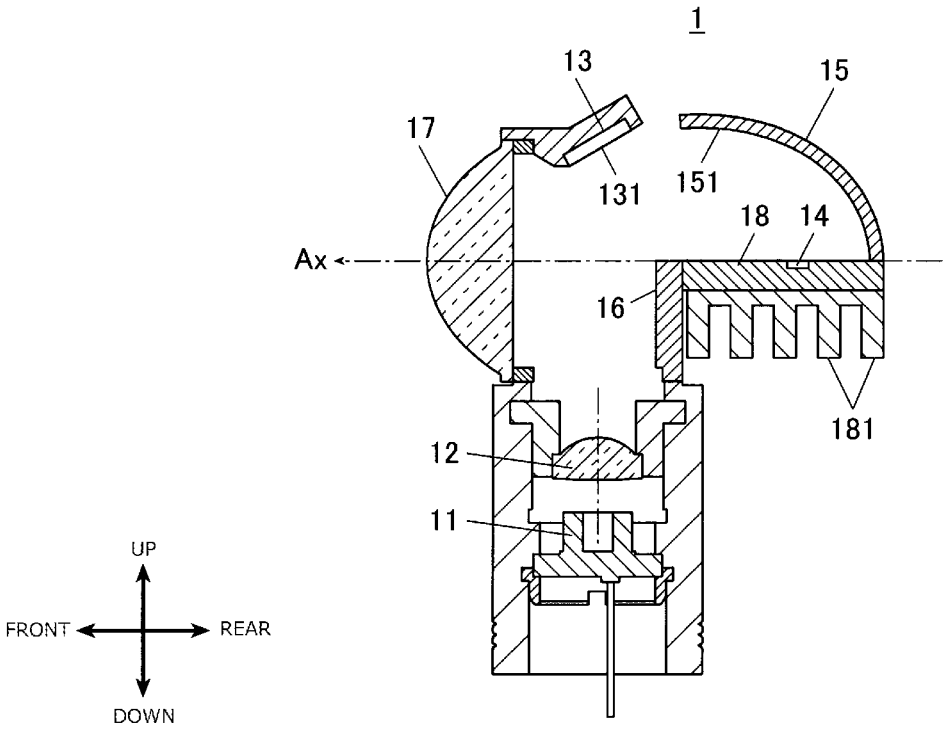
FIG. 2 is a cross-sectional side view of a vehicle lighting unit made in accordance with principles of the presently disclosed subject matter in the first exemplary embodiment.

FIG. 1 is a front view of a vehicle headlamp 100 containing vehicle lighting units 1 according to a first exemplary embodiment made in accordance with principles of the presently disclosed subject matter. FIG. 2 is a cross-sectional side view of the vehicle lighting unit 1.

As shown in FIG. 1, the vehicle headlamp 100 can include a plurality of the vehicle lighting units 1 in a lighting chamber covered with a transparent cover 101 at its front side. The plurality of vehicle lighting units 1 can emit light to form a predetermined light distribution pattern such as a low beam pattern in front of a vehicle body.

As shown in FIG. 2, the vehicle lighting unit 1 can be a so-called projector type lighting unit, and can include a laser diode (hereinafter referred to as "LD") 11, a collecting lens 12, a mirror 13, a wavelength conversion material 14, for example, being a phosphor (hereinafter, simply referred to as the phosphor 14), a reflector 15, a shade 16, and a projector lens 17.

Figure 3:
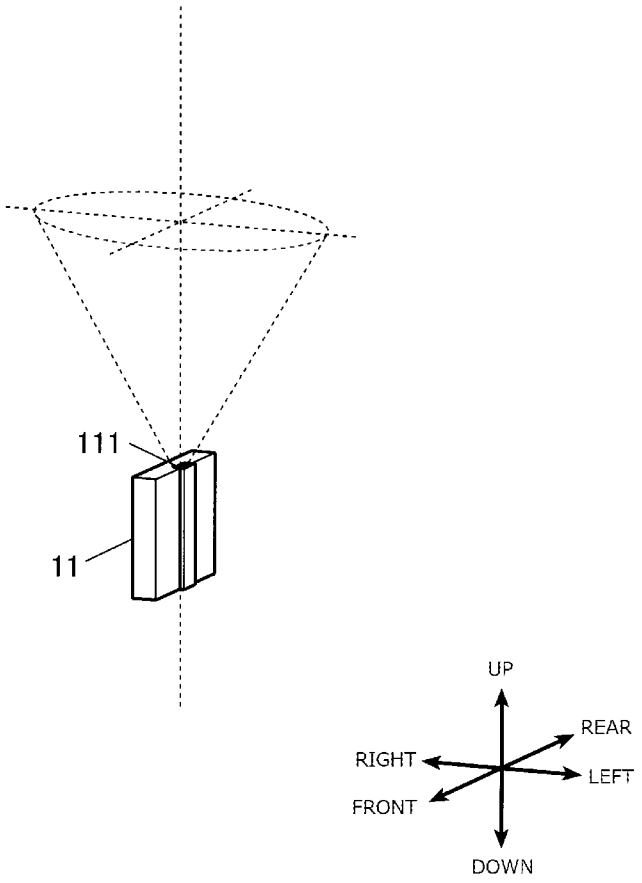
FIG. 3 is a schematic perspective view illustrating a portion of a laser diode (LD) (semiconductor laser light source) of the vehicle lighting unit of the first exemplary embodiment.
Figure 4:
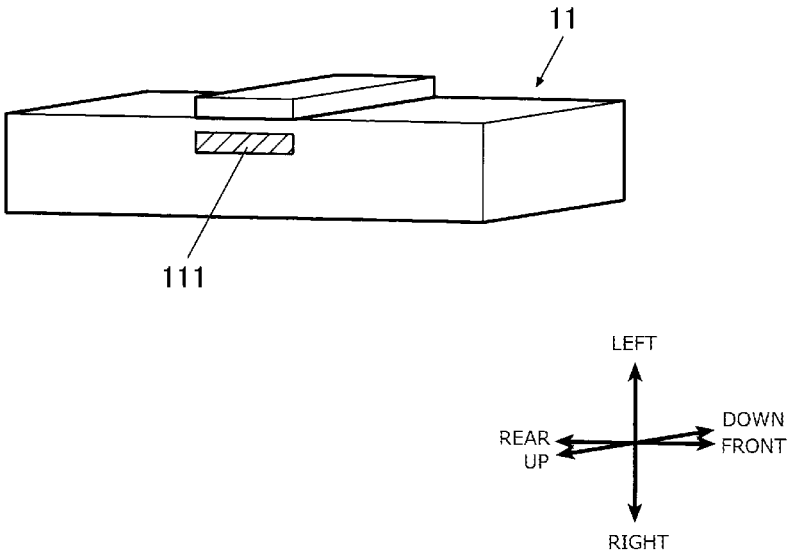
FIG. 4 is another schematic perspective view illustrating the portion of the LD of the first exemplary embodiment.

The LD 11 can be a semiconductor laser light source, and can emit blue laser light with a wavelength of 450 nm upward as excitation light for the phosphor 14. The LD 11 can have a light emitting portion 111 which can emit blue laser light and be exposed upward as shown in FIGS. 2 to 4. The light emitting portion 111 can have an elongated shape and the LD 11 can be disposed such that the elongated shape of the light emitting portion 111 is aligned in a front-to-rear direction.

Specifically, the LD 11 can have a stacked structure in which GaN substrate and the like are stacked, and the stacking direction can be aligned in a right-to-left direction. The blue laser light emitted from the thus configured LD 11 can be spread wider in a direction of a short width (in the right-to-left direction in FIG. 3) of the light emitting portion 111 than in a direction of a long width of the light emitting portion 111 (in the longitudinal direction of the light emitting portion 111 or in the front-to-rear direction in FIG. 3). In the present exemplary embodiment, the directivity angle of the light emitting portion 111 along the longitudinal direction is 10 degrees and that along the short width direction is 30 degrees, for example. Further, the blue laser light emitted from the LD 11 can include mainly a linear polarization component along the longitudinal direction of the light emitting portion 111.

The collecting lens 12 as shown in FIG. 2 can be disposed immediately above the LD 11 and can isotropically collect blue laser light emitted upward from the LD 11 onto a top surface of the phosphor 14 via the mirror 13 disposed thereabove, with the spot of collected light having substantially the same shape as that of the light emitting portion 111 of the LD 11. Specifically, the collecting lens 12 can collect blue light from the LD 12 at a substantial center of the phosphor 14 in the thickness direction via the surface thereof. The collecting lens 12 may be either a spherical convex lens or an aspherical convex lens.

The mirror 13 can be disposed above the collecting lens 12 and have a planar reflection surface 131 formed in the lower surface of the mirror 13. The reflection surface 131 can be disposed to be inclined rearward so that the blue light emitted from the LD 11 upward via the collecting lens 12 can be reflected obliquely downward and rearward at a depression (directivity angle) of 30 degrees.

The wavelength conversion material or phosphor 14 can be provided within a concave portion formed on the top surface of a metal plate 18 arranged obliquely upward and rearward with respect to the collecting lens 12. The wavelength conversion material may be a phosphor ceramics made of YAG ($Y_3Al_5O_{12}:Ce^{3+}$) that can be excited by blue light emitted from the LD 11 to emit yellow light. Accordingly, when the phosphor 14 receives the blue light, the blue light can be scattered by the phosphor 14 while also exciting the phosphor 14 so that the phosphor 14 can emit yellow light. The scattered blue light can be mixed with the produced yellow light, so that the white light (pseudo white light) can be generated.

In the present exemplary embodiment, the surface (top surface) of the phosphor 14 may be mirror finished. Further, the area of the surface of the phosphor 14 can be substantially the same as the area of the collected spot of blue light collected by the collecting lens 12, meaning that the area of the surface of the phosphor 14 is substantially the same as the area of the light emitting portion 111 of the LD 11. With this configuration, the light from the phosphor 14 can serve as a point light source with the same size as that of the light emitting portion 111 of the LD 11 to provide white light.

The phosphor 14 can be disposed such that the blue light emitted from the LD 11 and reflected by the mirror 13 can be incident thereon (upper surface) by an incident angle of 60 degrees. The incident angle herein can be a Brewster's angle (polarization angle) wherein the p-wave component parallel to the incident surface (surface crossing in the right-to-left direction) can have a reflectance of 0 (zero).

The upper surface of the metal plate 18 for supporting the phosphor 14 and including the concave portion where the phosphor 14 is disposed can be subjected to mirror finishing such as aluminum deposition. With this configuration, the white light exiting downward from the phosphor 14 can be reflected upward. On the lower surface of the metal plate 18, a plurality of cooling fins 181 can be provided in order to avoid or suppress an increase in temperature of the phosphor 14 as well as prevent the phosphor 14 from emitting a lower intensity of fluorescent light due to temperature quenching of the phosphor 14. The phosphor 14 and the metal plate 18 can be bonded by a bonding material including an inorganic adhesive. Note that although the bonding material can be any common material as long as it has favorable heat conductivity, light transmittance and light reflection properties, the bonding material may be low-melting point glass or a brazing metal (bonded by brazing).

The reflector 15 can have a curved shape with an opening obliquely forward and downward, so that the rear portion of the reflector 15 can cover the area above the phosphor 14. The lower surface of the reflector 15 can be a reflecting surface 151 configured such that the light from the phosphor 14 can be reflected by the same forward and diffused wider in the right-to-left direction than in the vertical direction.

Herein, the reflecting surface 151 can be formed of a free curved surface based on a revolved ellipsoid having a first focal point at or near the position of the phosphor 14 so that the eccentricity becomes larger from the curve appearing in the vertical cross-section to the curve appearing in the horizontal cross-section. The resulting reflecting surface 151 can reflect the white light emitted from the phosphor 14 so as to converge the light at or near (i.e., substantially at) the front end of the shade 16 in the vertical cross-section and gradually forward in the horizontal cross-section.

Figure 6:
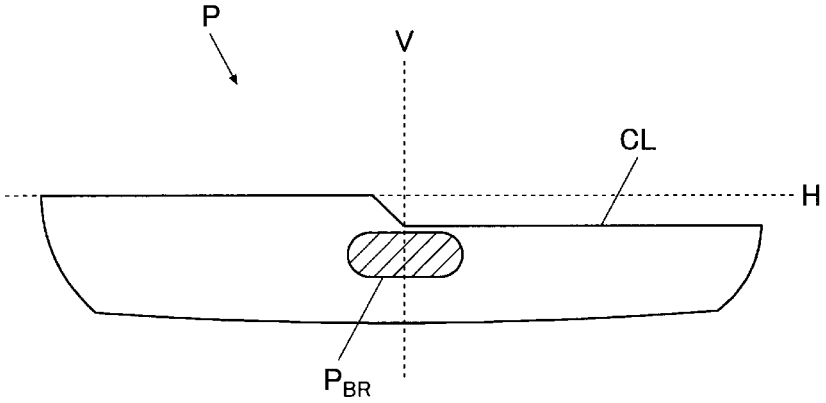
FIG. 6 is a diagram showing a light distribution pattern formed by the vehicle lighting unit in the first exemplary embodiment.

The shade 16 can be a light-shielding member that may be formed integrally with the front end of the metal plate 18. The shade 16 can shield part of white light reflected by the reflecting surface 151 of the reflector 15 so as to form a cut-off line CL in the low beam distribution pattern P as shown in FIG. 6. The upper surface of the shade 16 can be substantially flush with the upper surface of the metal plate 18 and can be subjected to aluminum deposition treatment like the upper surface of the metal plate 18, so that the white light that has been reflected by the reflecting surface 151 and incident on the upper surface thereof can be reflected toward the front projection lens 17.

The projection lens 17 can be an aspherical convex lens having an optical axis Ax along the front-to-rear direction and a front convex surface. The projection lens 17 can be disposed in front of the reflector 15 and the shade 16 so that the respective upper surfaces of the shade 16 and the metal plate 18 and the phosphor 14 are located on the optical axis Ax. The projection lens 17 can have a focal point on the rear side positioned at or near the front end of the shade 16. The white light having been reflected by the reflecting surface 151 of the reflector 15 can be incident on the projection lens 17 and reversed and projected forward of the vehicle body.

Next, a description will be given of the operation of the vehicle lighting unit 1 when forming the light distribution pattern for a low beam.

Figure 5A:
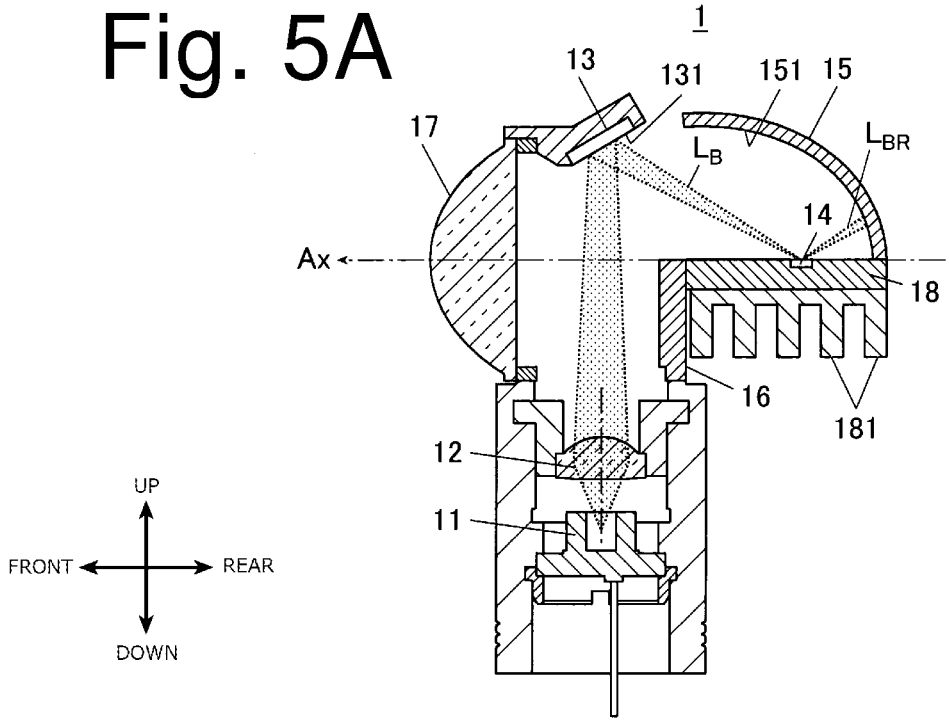
FIGS. 5A and 5B are each a cross-sectional side view illustrating optical paths in the vehicle lighting unit in the first exemplary embodiment.
Figure 5B:
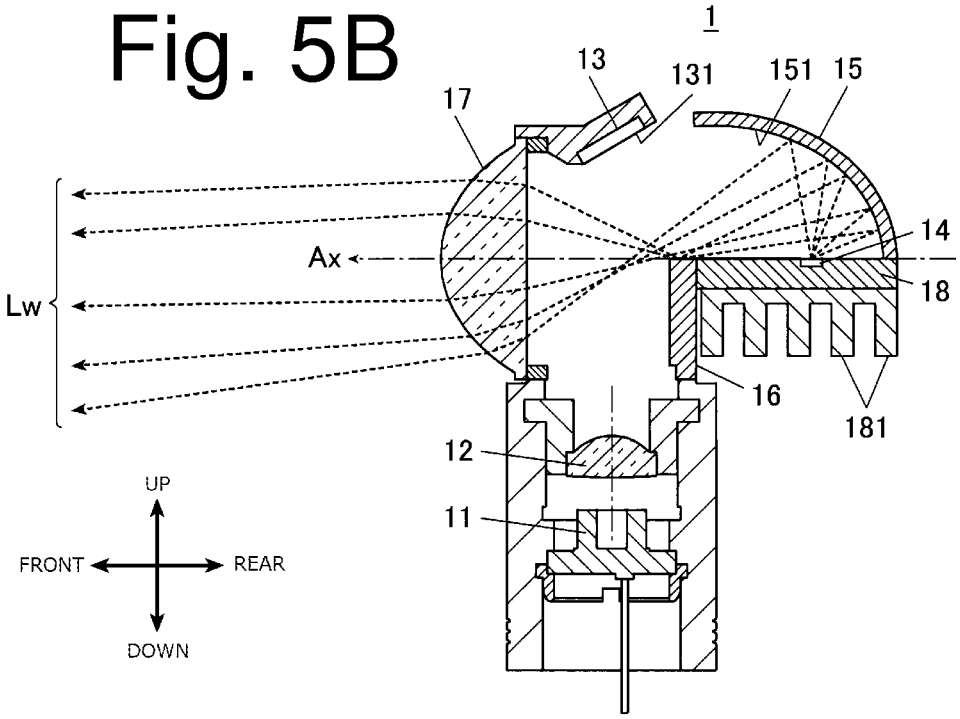
Figure 7:
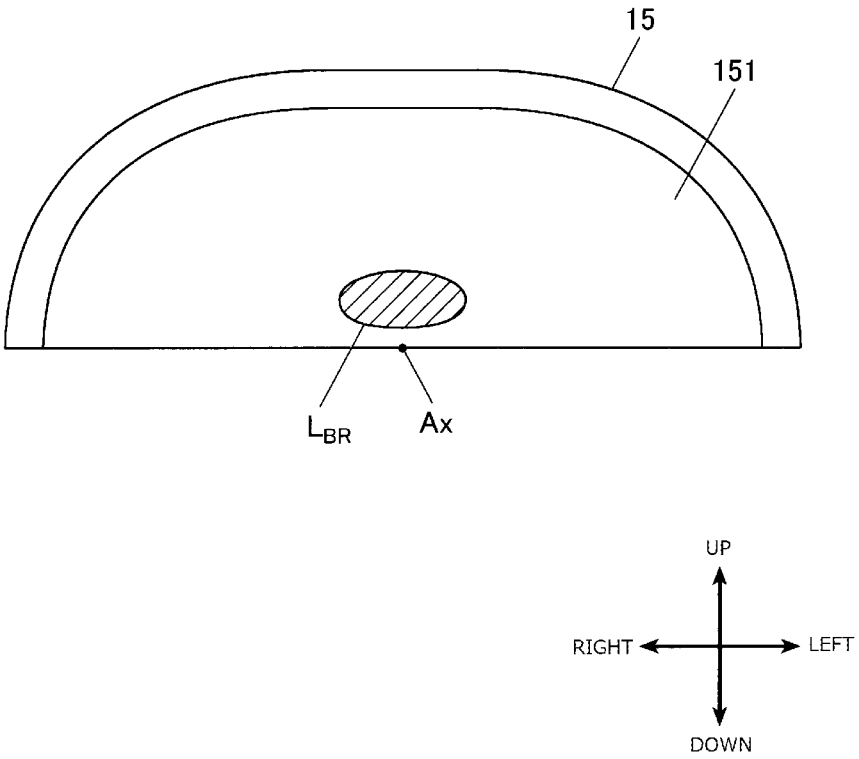
FIG. 7 is a front view of a reflector of the vehicle lighting unit in the first exemplary embodiment when blue light is reflected off the surface of a phosphor and is irradiated thereon.

FIGS. 5A and 5B are views illustrating the optical paths in the vehicle lighting unit 1. FIG. 6 is a diagram showing a light distribution pattern formed by the vehicle lighting unit 1 on a virtual screen in front of the vehicle body. FIG. 7 is a front view of the reflecting surface 151 when blue light regularly reflected off the surface of the phosphor 14 is irradiated thereon.

When the vehicle lighting unit 1 is turned on to activate the LD 11, as shown in FIG. 5A, the blue light (blue laser light) $L_B$ emitted from the LD 11 can be reflected by the reflecting surface 131 of the mirror 13 while being converged by the collecting lens 12, and can be incident on the surface of the phosphor 14 from the obliquely upward and forward location. Then, almost all or substantially all the blue light $L_B$ having been incident on the phosphor 14 can be converted to white light $L_W$ (addition of blue light and yellow light), which exits upward in a radial direction while part of blue light $L_B$ may be reflected off the surface (upper surface) of the phosphor 14 without converting to white light $L_W$.

As shown in FIG. 5B, the white light $L_W$ exiting upward from the phosphor 14 can be reflected by the reflecting surface 151 of the reflector 15 forward and projected through the projection lens 17 forward of the vehicle body. At that time, the white light $L_W$ directed to the lower part of the projection lens 17 can be shielded by the shade 16 in part, so that the low beam distribution pattern P of FIG. 6 can be formed by shielding the illumination light above the cut-off line CL.

On the other hand, part of the blue light $L_{BR}$ reflected off the surface of the phosphor 14 without converting to white light $L_W$ can be incident on the reflecting surface 151 as shown in FIG. 5A. The blue light $L_B$ can be emitted from the light emitting portion 111 of the LD 11 so that the light can be spread wider in the right-to-left direction than in the front-to-rear direction and converged on the surface of the phosphor 14 with the spot of collected light having substantially the same shape as that of the light emitting portion 111 of the LD 11. Accordingly, the blue light $L_{BR}$ that has been reflected off the surface of the phosphor 14 can be incident on the reflecting surface 151 while being spread wider in the right-to-left direction than in the front-to-rear direction. As a result, the blue light $L_{BR}$ can be illuminated on the reflecting surface 151 in an elongated shape along the right-to-left direction as shown in FIG. 7. The blue light $L_{BR}$ can then be reflected by the reflecting surface 151 while diffused wider in the right-to-left direction than in the vertical direction. Accordingly, as shown in FIG. 6, the illuminated portion $P_{BR}$ illuminated with the blue light $L_{BR}$ in the low beam distribution pattern P can be an area diffused wider in the right-to-left direction.

In this case, the blue light $L_B$ can have a linear polarization component along the front-to-rear direction, and can be impinge on the surface of the phosphor 14 by a Brewster's angle. Therefore, since the linear polarization component can be reflected off the surface of the phosphor 14 with low reflectivity, the light amount of the blue light $L_B$ reflected off the surface of the phosphor 14 can be decreased.

As discussed above, according to the vehicle lighting unit 1, of the total amount of blue light $L_B$ emitted from the LD 11, the blue light $L_{BR}$ reflected off the surface of the phosphor 14 can be used to illuminate the reflecting surface 151 along the right-to-left direction in an elongated shape. Therefore, the blue light $L_{BR}$ can be diffused wider by the reflecting surface 151 in the right-to-left direction. In this manner, the illuminated portion $P_{BR}$ illuminated with the blue light $L_{BR}$ in the low beam distribution pattern P can be an area diffused wider in the right-to-left direction. This configuration can reduce the coherency of the blue light $L_{BR}$. Furthermore, while the color of the blue light $L_{BR}$ can be thinned down, the blue light $L_{BR}$ can exit from the vehicle lighting unit. Therefore, the vehicle lighting unit 1 can suppress color unevenness of the light distribution pattern (for a low beam P) while ensuring the usefulness of the LD 11.

Furthermore, the blue light $L_B$ emitted from the LD 11 can have a linear polarization component along the front-to-rear direction, and can impinge on the surface of the phosphor 14 by a Brewster's angle. Therefore, since the linear polarization component can be reflected off the surface of the phosphor 14 with the suppressed reflectivity, the light amount of the blue light $L_B$ regularly reflected off the surface of the phosphor 14 can be decreased. Thus, the vehicle lighting unit 1 can further suppress the color unevenness of the light distribution pattern (for a low beam P) while ensuring the usefulness of the LD 11 to a greater extent.

If the blue light $L_B$ emitted from the LD 11 and anisotropically distributed is made into a collected spot isotropically and converged onto the surface of the phosphor 14, a plurality of optical lenses instead of the collecting lens 12 can be used. However, according to the presently disclosed subject matter, it is sufficient to form an elongated spot of collected light corresponding to the shape of the light emitting portion 111 of the LD 11. Thus, the blue light $L_B$ can be collected only by the collecting lens 12 with a common spherical or aspheric convex lens, thereby reducing the part costs as well as manufacturing costs.

Next, another exemplary embodiment will be described.

Figure 8:
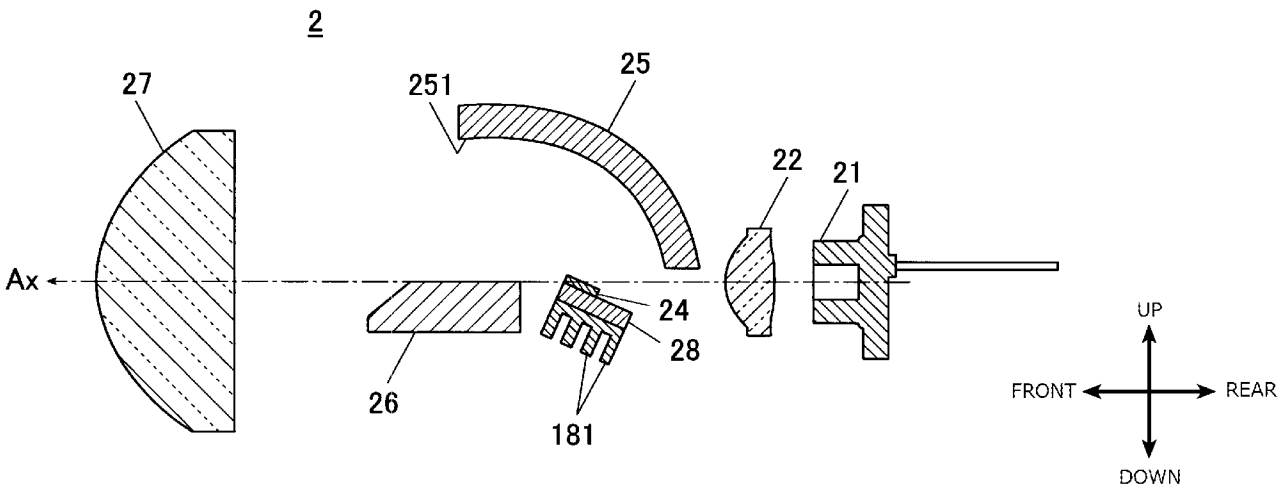
FIG. 8 is a cross-sectional side view of a vehicle lighting unit made in accordance with principles of the presently disclosed subject matter according to another exemplary embodiment.

FIG. 8 is a cross-sectional side view of a vehicle lighting unit 2 made in accordance with principles of the presently disclosed subject matter and according to another exemplary embodiment.

As shown in FIG. 8, the vehicle lighting unit 2 can be a so-called projector type lighting unit, and can include a LD 21, a collecting lens 22, a wavelength conversion material 24, for example, being a phosphor (hereinafter, simply referred to as the phosphor 24), a reflector 25, a shade 26, and a projector lens 27.

The LD 21 can be a semiconductor laser light source, and can emit blue light for excitation of the phosphor 24 forward along an optical axis Ax of the projector lens 27 to be described later.

Figure 9:
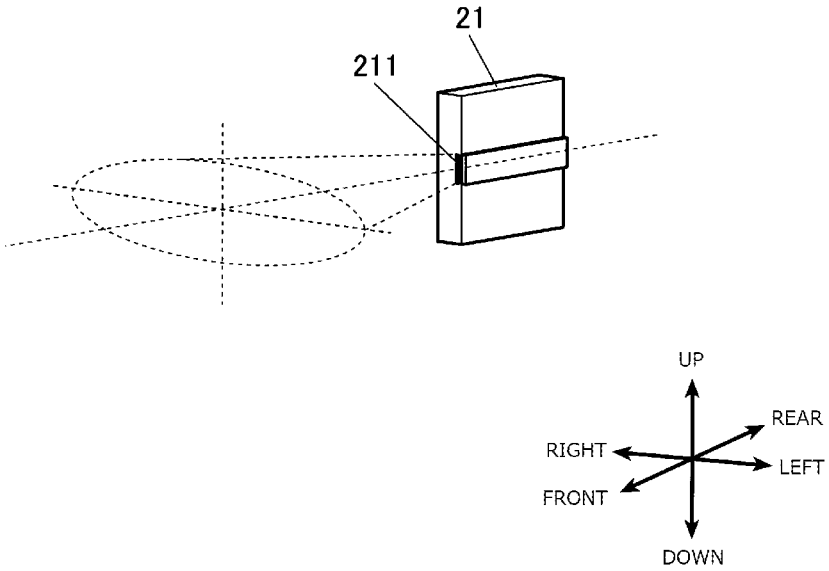
FIG. 9 is a schematic perspective view illustrating a portion of a laser diode (LD) (semiconductor laser light source) of the vehicle lighting unit in the exemplary embodiment of FIG. 8.

The LD 21 can have a light emitting portion 211 having an elongated shape as in the first exemplary embodiment. As shown in FIG. 9, the LD 21 can be disposed such that the elongated shape of the light emitting portion 211 is aligned in a vertical direction. The blue laser light emitted from the thus configured LD 21 can be spread wider in a right-to-left direction than in the longitudinal direction. The other configuration of the LD 21 can be the same as that of the LD 11 in the exemplary embodiment of FIG. 2.

The collecting lens 22 as shown in FIG. 8 can be disposed in front of the LD 21 and can isotropically collect blue laser light emitted forward from the LD 21 onto a top surface of the phosphor 24 disposed in front of the collecting lens 22, with the spot of collected light having substantially the same shape as that of the light emitting portion 211 of the LD 21. Specifically, the collecting lens 22 can collect blue light from the LD 22 at a substantial center of the phosphor 24 in the thickness direction via the surface thereof. The collecting lens 22 may, for example, be either a spherical convex lens or an aspherical convex lens.

The phosphor 24 can be a phosphor ceramics similar to the phosphor 14 of the exemplary embodiment of FIG. 2, and disposed in front of the collecting lens 22. Specifically, the top surface of the phosphor 24 can be inclined rearward. The phosphor 24 can be supported on the upper surface of the metal plate 28 also inclined rearward. The metal plate has the upper surface having been subjected to mirror finishing such as aluminum deposition and the lower surface can be provided with a plurality of cooling fins 181. The other configuration of the phosphor 24 can be the same as that of the phosphor 14 of the exemplary embodiment of FIG. 2.

The reflector 25 can be configured similar to the reflector 15 of the exemplary embodiment of FIG. 2. The lower surface of the reflector 25 can be a reflecting surface 251 configured such that the light from the phosphor 24 can be reflected by the same forward and diffused wider in the right-to-left direction than in the vertical direction. The reflecting surface 251 can be formed of a free curved surface based on a revolved ellipsoid having a first focal point at or near the position of the phosphor 24. The reflecting surface 251 can reflect the white light emitted from the phosphor 24 so as to converge the light to or near the front end of the shade 26 in the vertical cross-section and gradually forward in the horizontal cross-section.

The shade 26 can be a light-shielding member disposed in front of the phosphor 24. The shade 26 can shield a portion of white light reflected by the reflecting surface 251 of the reflector 25 so as to form a cut-off line CL in the low beam distribution pattern P as shown in FIG. 6. The upper surface of the shade 26 can be substantially subjected to aluminum deposition treatment like the upper surface of the metal plate 28, so that the white light that has been reflected by the reflecting surface 251 and incident on the upper surface thereof can be reflected toward the front projection lens 27.

The projection lens 27 can be an aspherical convex lens having an optical axis Ax along the front-to-rear direction and a front convex surface. The projection lens 27 can be disposed in front of the reflector 25 and the shade 26 so that the upper surface of the shade 26 and the phosphor 24 are located on the optical axis Ax. The projection lens 27 can have a focal point on the rear side positioned at or near (i.e., substantially at) the front end of the shade 26. The white light having been reflected by the reflecting surface 251 of the reflector 25 can be incident on the projection lens 27 and reversed and projected forward of the vehicle body.

Next, a description will be given of the operation of the vehicle lighting unit 2 when forming the light distribution pattern for a low beam.

Figure 10A:
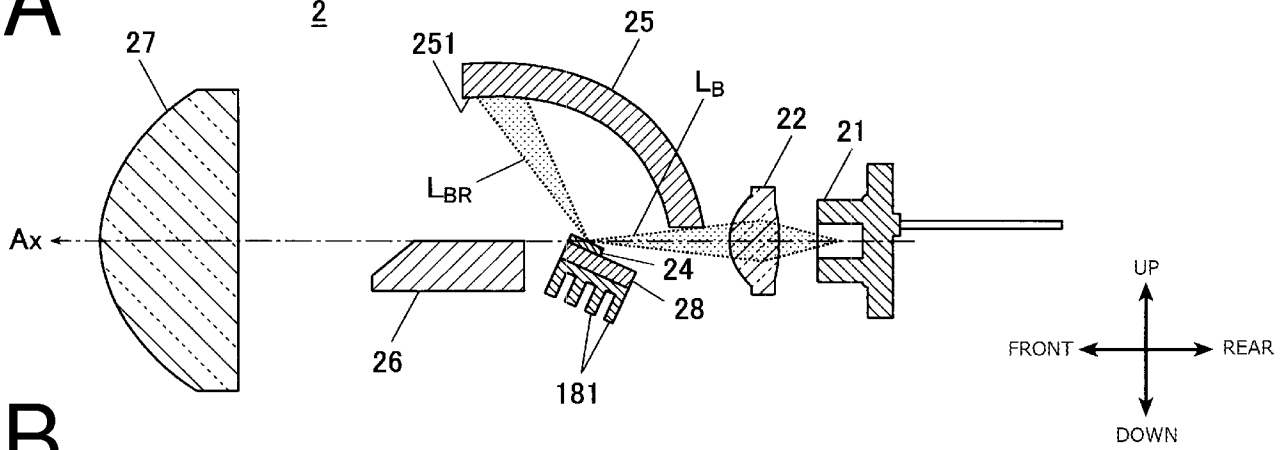
FIGS. 10A and 10B are each a cross-sectional side view illustrating optical paths in the vehicle lighting unit in the exemplary embodiment of FIG. 8.
Figure 10B:
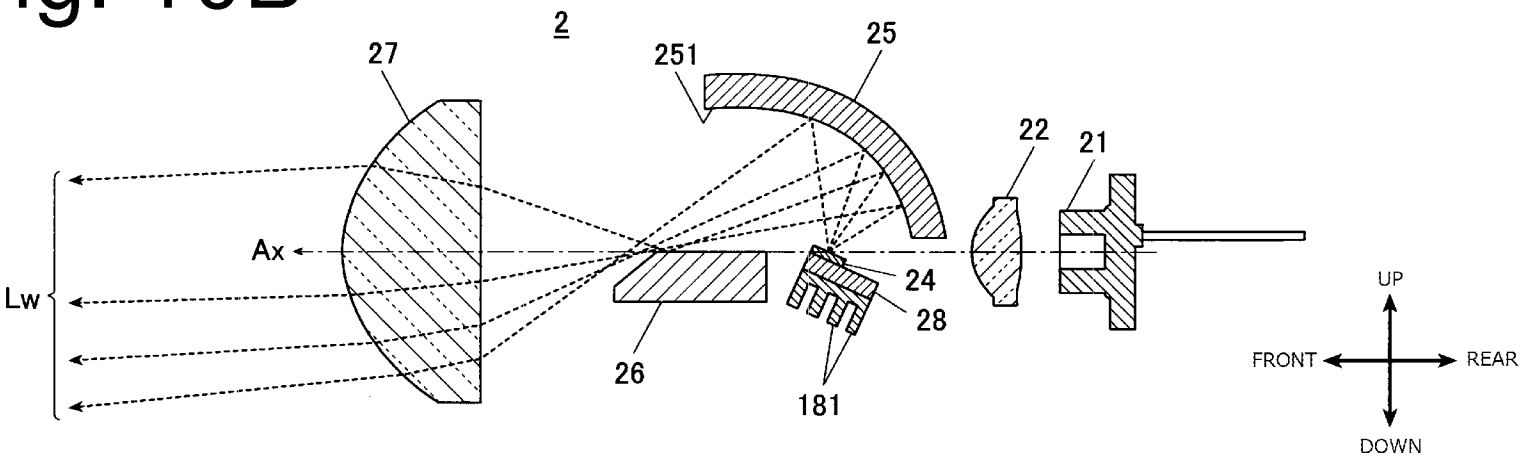

FIGS. 10A and 10B are each a cross-sectional side view illustrating optical paths in the vehicle lighting unit 2.

When the vehicle lighting unit 2 is turned on to activate the LD 21, as shown in FIG. 10A, the blue light (blue laser light) $L_B$ emitted from the LD 21 can be collected by the collecting lens 22 and can be incident on the surface of the phosphor 24 from the obliquely upward and rearward location. Then, the blue light $L_B$ having been incident on the phosphor 24 can be converted to white light $L_W$ (addition of blue light and yellow light), which exits upward in a radial direction while part of blue light $L_{BR}$ may be reflected off the surface (upper surface) of the phosphor 24 without converting to white light.

As shown in FIG. 10B, the white light $L_W$ exiting upward from the phosphor 24 can be reflected by the reflecting surface 251 of the reflector 25 forward and projected through the projection lens 27 forward of the vehicle body. At that time, the white light $L_W$ directed to the lower part of the projection lens 27 can be shielded by the shade 26 in part, so that the low beam distribution pattern P of FIG. 6 that is formed by shielding the illumination light above the cut-off line CL can be formed.

On the other hand, part of the blue light $L_{BR}$ reflected off the surface of the phosphor 24 without converting to white light $L_W$ can be incident on the reflecting surface 251 as shown in FIG. 10A. The blue light $L_B$ can be emitted from the light emitting portion 211 of the LD 21 so that the light can be spread wider in the right-to-left direction than in the vertical direction and converged on the surface of the phosphor 24 with the spot of collected light having substantially the same shape as that of the light emitting portion 211 of the LD 21. Accordingly, the blue light $L_{BR}$ that has been reflected off the inclined surface of the phosphor 24 can be incident on the reflecting surface 251 while being spread wider in the right-to-left direction than in the vertical direction (or front-to-rear direction). As a result, the blue light $L_{BR}$ can be illuminated on the reflecting surface 251 in an elongated shape along the right-to-left direction. The blue light $L_{BR}$ can then be reflected by the reflecting surface 251 while diffused wider in the right-to-left direction than in the vertical direction (front-to-rear direction). Accordingly, as shown in FIG. 6, the illuminated portion $P_{BR}$ illuminated with the blue light $L_{BR}$ in the low beam distribution pattern P can be an area diffused wider in the right-to-left direction.

In this case, the blue light $L_B$ can have a linear polarization component along the vertical direction because the longitudinal direction of the light emitting portion 211 is aligned in the vertical direction, and can be impinge on the surface of the phosphor 24 by a Brewster's angle. Therefore, the linear polarization component can be reflected off the surface of the phosphor 24 with the low reflectivity. As a result, the light amount of the blue light $L_B$ reflected off the surface of the phosphor 24 can be decreased.

The thus configured vehicle lighting unit 2 can achieve the same advantageous effects as those of the vehicle lighting unit 1 of the exemplary embodiment of FIG. 2.

Next, another exemplary embodiment will be described. Note that the same or similar components may be denoted by the same numerals as in the exemplary embodiment of FIG. 8, and descriptions thereof will be omitted here.

Figure 11:
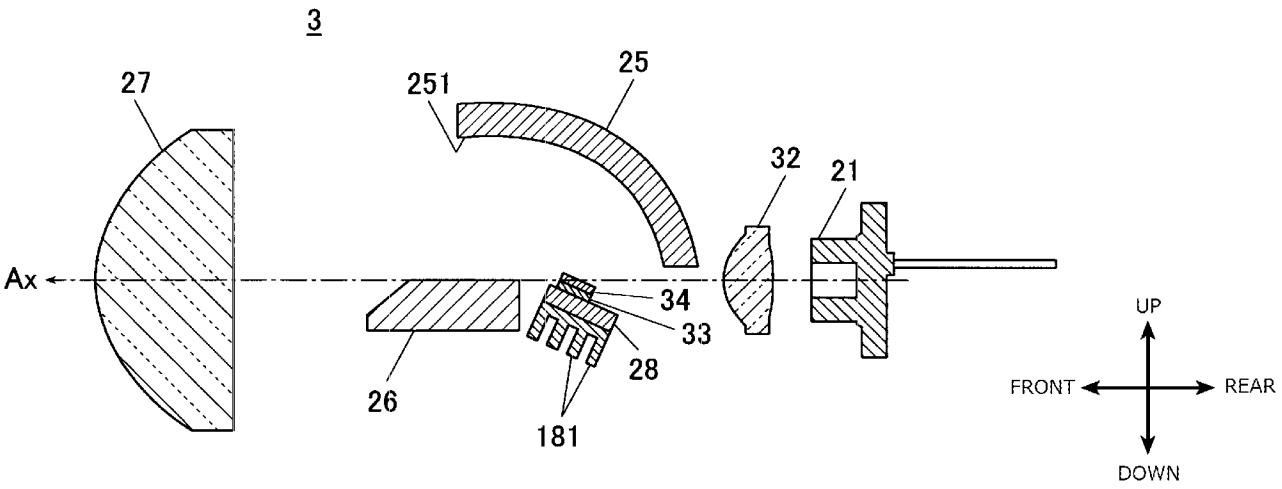
FIG. 11 is a cross-sectional side view of a vehicle lighting unit made in accordance with principles of the presently disclosed subject matter according to another exemplary embodiment.
Figure 12:
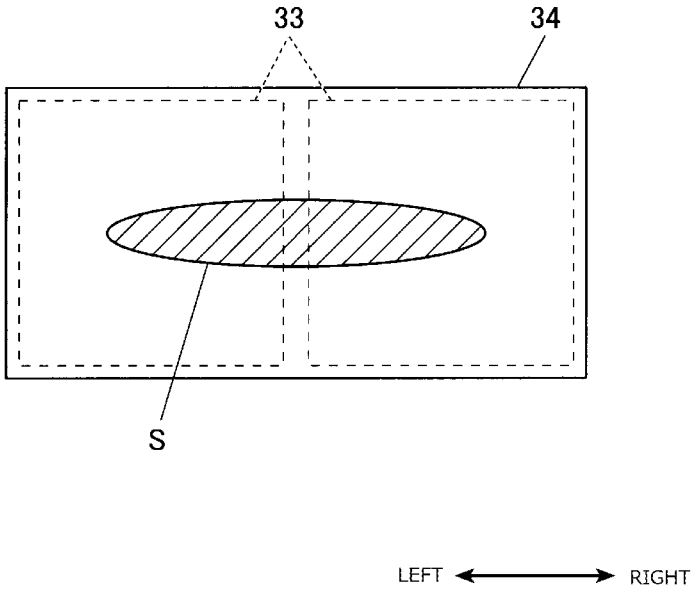
FIG. 12 is a plan view of a phosphor of the vehicle lighting unit in the exemplary embodiment of FIG. 11.

FIG. 11 is a cross-sectional side view of a vehicle lighting unit 3 made in accordance with principles of the presently disclosed subject matter according to another exemplary embodiment. FIG. 12 is a plan view of a phosphor 34 provided in the vehicle lighting unit 3.

As shown in FIG. 11, the vehicle lighting unit 3 can include, in addition to the LD 21, the reflector 25, the shade 26, and the projector lens 27 as in the exemplary embodiment of FIG. 8, a collecting lens 32, two light-emitting diodes 33 (hereinafter simply referred to as the LED(s)), and a wavelength conversion material 34, for example, being a phosphor.

The collecting lens 32 can be disposed in front of the LD 21 and can isotropically collect blue laser light emitted forward from the LD 21 onto a top surface of the phosphor 34 disposed in front of the collecting lens 32. Specifically, the collecting lens 32 can collect the blue light from the LD 21 and irradiate the laser illuminated portion S at the substantial center of the surface of the phosphor 34 with the blue light. (See FIG. 12.) The collecting lens 32 can have a focal point at a slightly-shifted position from the surface of the phosphor 34 in the front-to-rear direction, so that the blue light can be converged at the laser illuminated portion S elongated in the right-to-left direction. The laser illuminated portion S can serve as a portion of the surface of the phosphor 34 that can emit white light to the high luminance area in the light distribution pattern (low beam distribution pattern P), which will be described later. The collecting lens 32 may, for example, be either a spherical convex lens or an aspherical convex lens.

The two LEDs 33 can each be an LED chip in a square shape with 1 mm side and emit blue light as excitation light for the phosphor 34. They can be arranged side by side with a gap of 0.1 mm (see FIG. 12). The LEDs 33 can be disposed on the upper surface of the metal plate 28 and in front of the collecting lens 32 while the top emission surfaces thereof are inclined rearward.

The phosphor 34 can be formed in a plate-like shape having a top surface (upper surface) and a rear surface (lower surface) with substantially the same size (the front shape and its area) as the entire area of the two adjacent LEDs 33. The phosphor 34 can be located on the optical axis Ax and cover the entire light emission surfaces of the LEDs 33. Accordingly, the surface of the phosphor 34 can be inclined rearward similar to the light emission surfaces of the LEDs 33. The phosphor 34 can be a phosphor ceramics that can be excited by blue light emitted from the LD 21 and the LEDs 33 to emit yellow light. The phosphor 34 can also be the same as the phosphor 14 of the exemplary embodiment of FIG. 2.

Next, a description will be given of the operation of the vehicle lighting unit 3 when forming the light distribution pattern for a low beam.

Figure 13A:
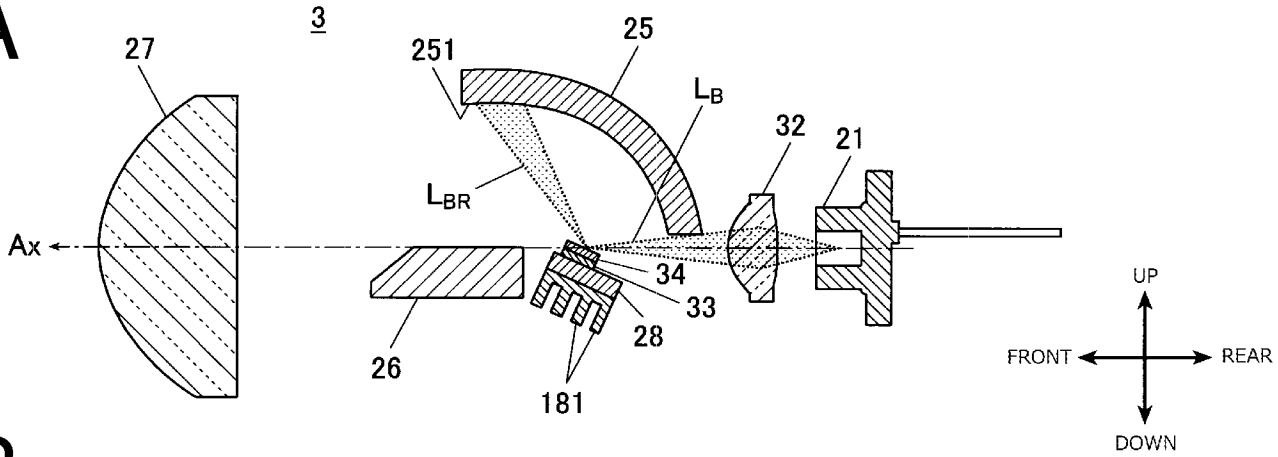
FIGS. 13A and 13B are each a cross-sectional side view illustrating optical paths in the vehicle lighting unit according to the exemplary embodiment of FIG. 11.
Figure 13B:
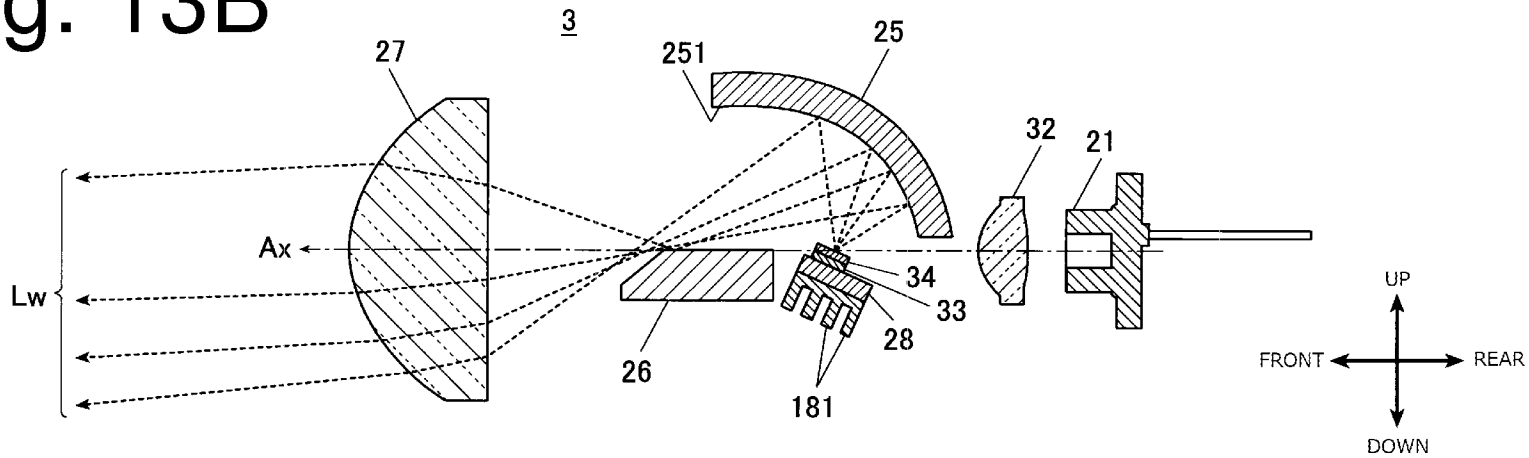

FIGS. 13A and 13B are each a cross-sectional side view illustrating optical paths in the vehicle lighting unit 3.

When the vehicle lighting unit 3 is turned on to activate the LD 21 as well as the LEDs 33, as shown in FIG. 13A, the blue light (blue laser light) $L_B$ emitted from the LD 21 can be collected by the collecting lens 32 and can be incident on the surface of the phosphor 34 from the obliquely upward and rearward location. In addition to this, the blue light emitted from the light emission surfaces of the LEDs 33 can be incident on the rear surface of the phosphor 34.

The blue light from the LEDs 33 can be converted to white light (the addition color of blue light and yellow light) via the phosphor 34 and can exit from the entire surface of the phosphor 34.

Then, almost all or substantially all the blue light $L_B$ having been incident on the phosphor 34 can be converted to white light, which exits upward from the laser illumination portion S of the surface thereof while part of blue light $L_{BR}$ may be reflected off the surface (upper surface) of the phosphor 34 without converting to white light.

As shown in FIG. 13B, the white light exiting upward from the phosphor 34 can be reflected by the reflecting surface 251 of the reflector 25 forward and projected through the projection lens 27 forward of the vehicle body. At that time, the white light directed to the lower part of the projection lens 27 can be shielded by the shade 26 in part, so that the low beam distribution pattern P of FIG. 6 that is formed by shielding the illumination light above the cut-off line CL can be formed. At that time, the white light from the laser illumination portion S with higher intensity by the blue light LB can be projected near the cut-off line CL in the low beam distribution pattern P, thereby forming a high luminance area (not shown) near the cut-off line CL.

On the other hand, part of the blue light $L_{BR}$ reflected off the surface of the phosphor 34 without converting to white light can be incident on the reflecting surface 251 as shown in FIG. 13A. The blue light $L_B$ can be emitted from the light emitting portion 211 of the LD 21 so that the light can be spread wider in the right-to-left direction than in the vertical direction and isotropically converged on the surface of the phosphor 34 by the collecting lens 32. Accordingly, the blue light $L_{BR}$ that has been reflected off the inclined surface of the phosphor 34 can be incident on the reflecting surface 251 while being spread wider in the right-to-left direction than in the vertical direction. As a result, the blue light $L_{BR}$ can be illuminated on the reflecting surface 251 in an elongated shape along the right-to-left direction. The blue light $L_{BR}$ can be then reflected by the reflecting surface 251 while diffused wider in the right-to-left direction than in the vertical direction (front-to-rear direction). Accordingly, as shown in FIG. 6, the illuminated portion $P_{BR}$ illuminated with the blue light $L_{BR}$ in the low beam distribution pattern P can be an area diffused wider in the right-to-left direction.

In this case, the blue light $L_B$ can have a linear polarization component along the vertical direction as in the second exemplary embodiment, and can impinge on the surface of the phosphor 34 by a Brewster's angle. Therefore, the linear polarization component can be reflected off the surface of the phosphor 34 with the low reflectivity. As a result, the light amount of the blue light $L_B$ regularly reflected off the surface of the phosphor 34 can be decreased.

As described above, the thus configured vehicle lighting unit 3 can achieve the same advantageous effects as those of the vehicle lighting unit 1 of the first exemplary embodiment. In addition to this, the vehicle lighting unit 3 can form the low beam distribution pattern P mainly by the white light derived from the blue light of the LEDs 33 with the high luminance area within the pattern P by the white light from the laser illumination portion S with high brightness due to the reception of the blue light $L_B$ from the LD 21. This can increase the luminance of the high luminance area that is used for illuminating farther places, thereby improving the far distance visibility.

Since the collecting lens 32 can have a focal point slightly shifted from the surface of the phosphor 34, thereby collecting the blue light $L_B$ at the laser illumination portion S in an elongated shape in the right-to-left direction. This configuration can thereby form such a high luminance area in an elongated shape in the right-to-left direction.

The presently disclosed subject matter is not limited to the above first to third exemplary embodiments and can be modified or changed as appropriate.

For example, the vehicle lighting units 1 to 3 in the first to third exemplary embodiments can form a low beam distribution pattern P with light, but can also form a high beam distribution pattern.

The combination of the wavelength conversion material and the color of light can be appropriately selected in accordance with the required specification (namely, the combination of the excitation light and the phosphor, for example as well as the emission color).

The blue light LB can be incident on the phosphor 14 to 34 by an incident angle of a Brewster's angle, but the angle may be in a range of 40 to 70 degrees as long as the linear polarization component can be reflected with the reflectivity of ±3%. By setting the angle to this range, the color unevenness in the light distribution pattern can be suppressed to a sufficient degree.

The blue light $L_B$ can mainly include the linear polarization component along the longitudinal direction of the light emitting portion 111, 211. Specifically, the ratio of the linear polarization component (p wave component parallel to the incident surface) to the polarization component along the short side direction of the light emitting portion 111, 211 (s wave component perpendicular to the incident surface) can be 100 or larger.

The surface (top surface) of the phosphor 14 to 34 may be provided with an antireflection film according to the wavelength of the blue light $L_B$ and the incident angle. This configuration can suppress the color unevenness of the light distribution pattern more by decreasing the reflectance of the blue light LB on the surface of the phosphor 14 to 34.

The surface of the phosphor 14 to 34 may be mirror finished or may have a concave-convex surface in part for diffusing the light while maintaining the directivity of the reflection light. This configuration can allow the blue light LB reflected off the surface of the phosphor 14 to 34 to maintain its directivity and be partly diffused. Accordingly, the color unevenness in the light distribution pattern can be suppressed to a greater extent.

In the above embodiments of FIGS. 2 and 8, the collecting lens 12, 22 can collect blue light $L_B$ onto the surface of the phosphor 14, 24 with the spot of collected light having substantially the same shape as that of the light emitting portion 111, 211 of the LD 11, 21. The collecting lens 12, 22 may collect the blue light $L_B$ with a spot of collected light in an elongated shape in the right-to-left direction by slightly shifting the focal point of the lens 12, 22 from the surface of the phosphor 14, 24. This configuration can facilitate the formation of the elongated light distribution pattern in the right-to-left direction.

In the exemplary embodiment of FIG. 11, the phosphor 34 can be formed in a plate-like shape. Since such a phosphor 34 may emit white light with color unevenness in accordance with the light intensity distribution of the illuminated blue light, the phosphor 34 can have a thickness distribution in accordance with the light intensity distribution of the blue light. In this case, the phosphor 34 can be configured such that the thickness from the rear surface to the front surface can be varied so as to be thicker at the portion where the intensity of the illuminated blue light is higher. Accordingly, the thickness of the phosphor 34 at the laser illumination portion S can be thicker than the thickness of the phosphor 34 at the other portions.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle lighting unit comprising:

a semiconductor laser light source;

a wavelength conversion material configured to receive excitation light emitted from the semiconductor laser light source and emit visible light by excitation;

a reflector configured to reflect the light emitted from the wavelength conversion material such that the light is diffused wider in a right-to-left direction than in a vertical direction on the basis of a posture where the lighting unit is mounted; and a mirror disposed in front of the reflector and configured to reflect the excitation light emitted from the semiconductor laser light source toward the wavelength conversion material, wherein the semiconductor laser light source is configured such that a portion of the excitation light emitted from the semiconductor laser light source and reflected off a surface of the wavelength conversion material is incident on the reflector with an elongated area in the right-to-left direction, the reflector covers an upper side of the wavelength conversion material, and the semiconductor laser light source is disposed below the mirror so as to emit the excitation light upward, and includes a light emitting portion which has an elongated shape and which is configured to emit the excitation light spread wider in a short width direction than in a longitudinal direction, and the semiconductor laser light source is configured such that the elongated shape of the light emitting portion is aligned in a front-to-rear direction.

2. The vehicle lighting unit according to claim 1, wherein:

the semiconductor laser light source includes the light emitting portion which has an elongated shape and which is configured to emit the excitation light; and the semiconductor laser light source is configured such that the excitation light emitted from the semiconductor laser light source includes a linear polarization component along a longitudinal direction of the light emitting portion and is incident on the wavelength conversion material by a Brewster's angle.

3. The vehicle lighting unit according to claim 2, comprising a collecting lens configured to collect the excitation light emitted from the semiconductor laser light source onto the surface of the wavelength conversion material, and wherein the collecting lens is one selected from a spherical convex lens and an aspherical convex lens.

4. The vehicle lighting unit according to claim 1, comprising a collecting lens configured to collect the excitation light emitted from the semiconductor laser light source onto the surface of the wavelength conversion material, and wherein the collecting lens is one selected from a spherical convex lens and an aspherical convex lens.

5. A vehicle unit comprising:

a semiconductor laser light source;

a wavelength conversion material configured to receive excitation light emitted from the semiconductor laser light source and emit visible light by excitation; and a reflector configured to reflect the light emitted from the wavelength conversion material such that the light is diffused wider in a right-to-left direction than in a vertical direction on the basis of a posture where the lighting unit is mounted, wherein:

the reflector is disposed to cover the upper side of the wavelength conversion material; and the semiconductor laser light source is disposed behind the wavelength conversion material so that the excitation light is emitted forward, and includes a light emitting portion which has an elongated shape and which is configured to emit the excitation light spread wider in a short width direction than in a longitudinal direction, and the semiconductor laser light source is configured such that the elongated shape of the light emitting portion is aligned in the vertical direction.

6. The vehicle lighting unit according to claim 5, wherein:

the semiconductor laser light source includes the light emitting portion which has an elongated shape and which is configured to emit the excitation light; and the semiconductor laser light source is configured such that the excitation light emitted from the semiconductor laser light source includes a linear polarization component along a longitudinal direction of the light emitting portion and is incident on the wavelength conversion material by a Brewster's angle.

7. The vehicle lighting unit according to claim 6, comprising a collecting lens configured to collect the excitation light emitted from the semiconductor laser light source onto the surface of the wavelength conversion material, and wherein the collecting lens is one selected from a spherical convex lens and an aspherical convex lens.

8. The vehicle lighting unit according to claim 5, comprising a collecting lens configured to collect the excitation light emitted from the semiconductor laser light source onto the surface of the wavelength conversion material, and wherein the collecting lens is one selected from a spherical convex lens and an aspherical convex lens.

9. A vehicle lighting unit comprising:

a semiconductor laser light source;

a wavelength conversion material configured to receive excitation light emitted from the semiconductor laser light source and emit visible light by excitation; and a reflector configured to reflect the light emitted from the wavelength conversion material such that the light is diffused wider in a right-to-left direction than in a vertical direction on the basis of a posture where the lighting unit is mounted, wherein:

the semiconductor laser light source includes a light emitting portion which has an elongated shape and which is configured to emit the excitation light; and the semiconductor laser light source is configured such that the excitation light emitted from the semiconductor laser light source includes a linear polarization component along a longitudinal direction of the light emitting portion and is incident on the wavelength conversion material by a Brewster's angle.

10. The vehicle lighting unit according to claim 9, comprising a collecting lens configured to collect the excitation light emitted from the semiconductor laser light source onto the surface of the wavelength conversion material, and wherein the collecting lens is one selected from a spherical convex lens and an aspherical convex lens.

11. A vehicle lighting unit comprising:

a semiconductor laser light source;

a wavelength conversion material configured to receive excitation ht emitted from the semiconductor laser light source and emit visible light by excitation;

a reflector configured to reflect the light emitted from the wavelength conversion material such that the light is diffused wider in a right-to-left direction than in a vertical direction on the basis of a posture where the lighting unit is mounted; and a collecting lens configured to collect the excitation light emitted from the semiconductor laser light source onto the surface of the wavelength conversion material, and wherein the collecting lens is one selected from a spherical convex lens and an aspherical convex lens.

* * * * *